US009157192B2

(12) United States Patent
Laborenz et al.

(10) Patent No.: US 9,157,192 B2
(45) Date of Patent: Oct. 13, 2015

(54) METHOD FOR PRODUCING A SLAB TRACKWAY

(75) Inventors: Peter Laborenz, Lüscherz (CH); Bruno Kiefer, Belp (CH); Anabel Hengelmann, Zurich (CH)

(73) Assignee: SONNEVILLE AG (CH)

( * ) Notice: Subject to any disclaimer, the term of this patent is extended or adjusted under 35 U.S.C. 154(b) by 148 days.

(21) Appl. No.: 13/976,221

(22) PCT Filed: Dec. 23, 2011

(86) PCT No.: PCT/EP2011/074024

§ 371 (c)(1),
(2), (4) Date: Jun. 26, 2013

(87) PCT Pub. No.: WO2012/089697

PCT Pub. Date: Jul. 5, 2012

(65) Prior Publication Data

US 2013/0277441 A1 Oct. 24, 2013

(30) Foreign Application Priority Data

Dec. 27, 2010 (EP) ..... 10197028

(51) Int. Cl.

| | |
|---|---|
| ***E01B 21/02*** | (2006.01) |
| ***E01B 1/00*** | (2006.01) |
| ***E01B 2/00*** | (2006.01) |
| ***E01B 29/00*** | (2006.01) |
| ***E01C 9/04*** | (2006.01) |

(52) U.S. Cl.

CPC ..... *E01B 1/001* (2013.01); *E01B 1/004* (2013.01); *E01B 1/008* (2013.01); *E01B 2/00* (2013.01); *E01B 29/005* (2013.01); *E01C 9/04* (2013.01); *E01B 2204/06* (2013.01)

(58) Field of Classification Search

CPC ..... E01B 1/00; E01B 1/008; E01B 21/00; E01B 21/02; E01B 21/04; E01B 2204/00; E01B 2204/01; E01B 2204/07; E01B 2204/11

USPC ..... 238/1–3, 5–9

See application file for complete search history.

(56) References Cited

U.S. PATENT DOCUMENTS 1,745,747 A * 2/1930 Day ..... 238/7
4,793,545 A 12/1988 Raymond

FOREIGN PATENT DOCUMENTS

DE 20 2009 008 366 U1 8/2009
DE 20 2008 008 157 U1 10/2009
DE 10 2010 030275 A1 3/2011

OTHER PUBLICATIONS

International Search Report dated Apr. 27, 2012 issued in corresponding International patent application No. PCT/EP2011/074024.
European Search Report dated Apr. 18, 2011 issued in corresponding European patent application No. EP 10 19 7028.

* cited by examiner

*Primary Examiner* — R. J. McCarry, Jr.
(74) *Attorney, Agent, or Firm* — Ostrolenk Faber LLP

(57) ABSTRACT

In order to produce a slab track for rail vehicles with an emergency pathway (12) for road vehicles, a prefabricated track section with rails (8) and sleepers (5) is supported and positioned on a substructure (1) by means of a supporting and aligning device (4). Subsequently, a track slab (10) is produced by casting in the sleepers (5). The part of the sleepers (5) that projects from the track slab (10) and the rails (8) are separated by formwork elements, and an emergency pathway (12) is applied to the track slab (10) by casting.

13 Claims, 3 Drawing Sheets

METHOD FOR PRODUCING A SLAB TRACKWAY

CROSS REFERENCE TO RELATED APPLICATIONS

The present application is a 35 U.S.C. §371 National Phase conversion of PCT/EP2011/074024, filed Dec. 23, 2011, which claims benefit of European Application No. 10197028.3, filed Dec. 27, 2010, the disclosure of which is incorporated herein by reference. The PCT International Application was published in the German language.

TECHNICAL FIELD OF THE INVENTION

The invention relates to a method for producing a slab track for rail vehicles with an emergency pathway for road vehicles wherein a prefabricated track section with rails and sleepers is supported and positioned on a substructure by means of a supporting and aligning device and a track slab is produced by casting in the sleepers.

BACKGROUND OF THE INVENTION

Slab tracks for rail vehicles are known in the art and are preferentially used in tunnels. To ensure quick rescue in the event of accidents and disturbances, such tracks are provided, particularly in tunnels, with emergency pathways that are drivable for road vehicles and of course also walkable for pedestrians. A requirement with regard to the latter is that tripping points are eliminated as far as possible.

Known emergency pathways consist of prefabricated plates, e.g. of concrete, resting on a track slab of filling concrete in which the sleeper blocks are embedded. In the case of tracks with elastically supported, vertically movable sleeper blocks, an additional requirement is that the plates of the emergency pathway do not hinder the mobility of the sleeper blocks. An advantage of such emergency pathways is that the dimensions and the weight of the prefabricated plates can be designed such that the plates can be transported and laid by conventional means. However, a disadvantage is that the dimensions of the plates have to be adapted to the gauge, the sleeper block dimensions, the sleeper block spacing, and the slope of the filling concrete track slab. A slope is required to drain water. All these variable parameters make it uneconomical to keep a stock of prefabricated plates. A further disadvantage of emergency pathways of this kind is that the plates often do not rest stably on the filling concrete track slab so passing vehicles cause a tilting movement and the plates are thus subject to high local wear.

On the background of this prior art, it is the object of the invention to provide a method for producing a slab track for rail vehicles with an emergency pathway for road vehicles that is simple and cost-efficient to implement and that results in a slab track provided with a positionally stable emergency pathway having a high load capacity.

SUMMARY OF THE INVENTION

According to the invention, this object is achieved in that the part of the sleepers that projects from the track slab and the rails are separated by formwork elements and an emergency pathway is applied to the track slab by casting.

In particular, this method offers the advantage that the emergency pathway precisely fits onto the track slab and rests thereon stably. Furthermore, the need for prefabricating and more particularly keeping a stock of plates for the emergency pathway is eliminated.

According to one embodiment of the method, the formwork elements are attached before the track slab is cast. This modus operandi offers the advantage that it is not necessary to step on the track slab to attach the formwork elements after casting the track slab and that the emergency pathway may possibly be applied before the track slab has completely hardened.

According to a further embodiment of the method, the supporting and aligning device is removed before the emergency pathway is cast. This has the advantage that no parts or traces of the supporting and aligning device remain in the emergency pathway.

The invention also relates to a slab track produced according to the method of the invention.

In one embodiment of the slab track, a drainpipe is arranged in the substructure and communicates with the surface of the substructure via connecting openings provided in the substructure at certain intervals. A substructure prepared in this manner eliminates the need for the subsequent installation of a drainage system.

According to a further embodiment, the track slab is provided with connecting openings which communicate with the connecting openings provided in the substructure. It is very simple to provide the track slab with such connecting openings, e.g. by inserting formed parts before the track slab is cast.

According to another embodiment, the emergency pathway is divided by joints extending substantially transversely to the rails. These joints absorb expansions and contractions of the emergency pathway. Furthermore, this allows an easy stepwise manufacture of the emergency pathway in accordance with the length of the prefabricated track sections.

According to a further embodiment, the emergency pathway is provided with drainage shafts which communicate with the connecting openings of the track slab. These drainage shafts are preferably arranged in the area of the joints and ensure the drainage of water from the emergency pathway.

If according to another embodiment the surface of the emergency pathway is provided with drainage channels, the drainage of the emergency pathway is further improved.

According to a further embodiment, the sleepers have a heightened shoulder on at least one side of the rail whose surface is at least approximately flush with the surface of the emergency pathway. In this manner, gaps in the emergency pathway that might otherwise remain after removing the formwork elements are largely closed.

The invention further relates to formwork elements for implementing the method of the invention. The main object of these elements is to allow a quick setup and removal.

According to the invention, this object is achieved in that the formwork elements consist of hoods that are intended to be fitted over parts of the sleepers and of plates connecting adjacent hoods. These hoods and plates are quickly mountable and dismountable and are furthermore reusable.

According to one embodiment of the formwork elements, the plates are removably connectable to the hoods. This measure also facilitates the mounting and dismounting of the formwork elements.

According to a further embodiment of the formwork elements, the plates are connectable to the hoods such that the spacing between adjacent hoods is variable. This eliminates the need for providing plates of different lengths in accordance with different sleeper spacings.

BRIEF DESCRIPTION OF THE DRAWINGS

Exemplary embodiments of the invention will be described in more detail hereinafter by way of examples with reference to the appended drawings.

DESCRIPTION OF PREFERRED EMBODIMENTS

Figure 1:
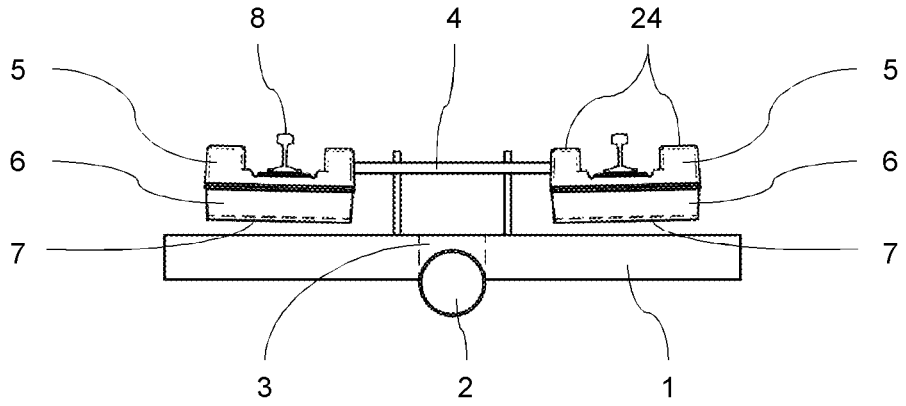
FIGS. 1 to 6 show six steps of an embodiment of the method according to the invention in respective sectioned views taken transversely to the travel direction.

In FIG. 1, the initial situation in an embodiment of the method according to the invention is illustrated by way of example. A track section comprising a plurality of sleeper blocks 5 and of rails 8 mounted thereon is supported and aligned on a substructure 1, e.g. of reinforced concrete, by means of a supporting and aligning device 4. In the substructure extends a drainpipe 2 that communicates with the upper side of substructure 1 via connecting openings 3 arranged at certain intervals. In order to damp vibrations produced later when vehicles are passing on the track, a respective rubber shoe 6 in which an elastic inlay 7 is arranged is fitted over the bottom of each sleeper block 5. As appears in the Figure, sleeper blocks 5 are provided on both sides of rail 8 with upwardly projecting shoulders 24 whose upper surfaces are walkable or drivable for road vehicles later in the finished track. The invention is not limited to a track including sleeper blocks 5 of this kind, however.

Figure 2:
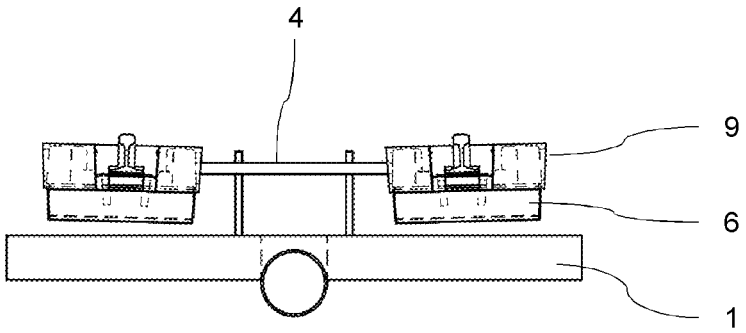
Figure 5:
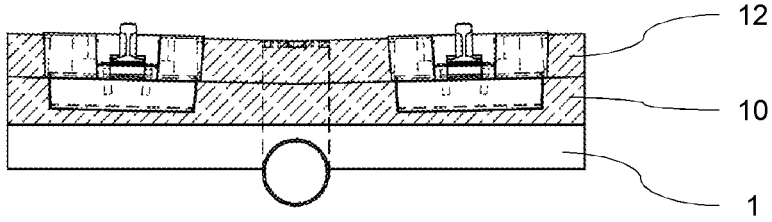

In the illustration according to FIG. 2, a respective formwork hood 9 is fitted over each sleeper block 5 whose purpose it is to prevent the access of concrete to sleeper blocks 5 and rails 8 during the subsequent casting of an emergency pathway 12 (FIG. 5). As a further measure before casting track slab 10, the placement of formwork elements may possibly be required in the area of the lateral edges of the substructure. These formwork elements may consist of known formwork panels and are not shown in the Figures.

Figure 3:
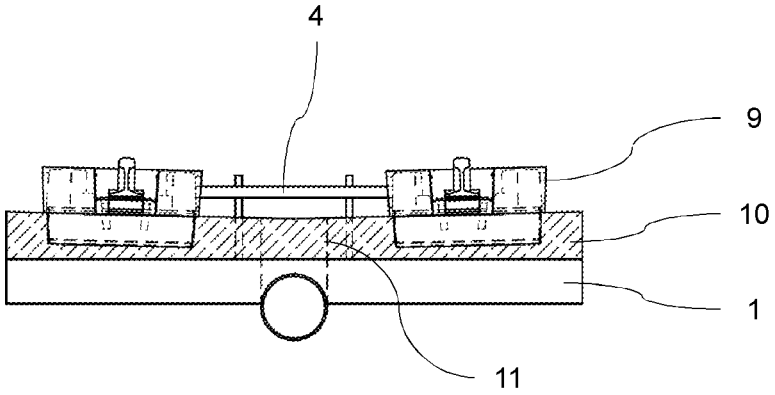

FIG. 3 shows the situation after the casting of track slab 10, which may e.g. consist of non-reinforced concrete. Basically, formwork hoods 9 might be fitted after the casting of track slab 10 also. However, fitting them beforehand, as shown in the Figures, offers the advantage that it is not necessary to step onto track slab 10 to fit formwork hoods 9. Track slab 10 has connecting openings 11 for drainage that are arranged at certain intervals and aligned with connecting openings 3 mentioned with reference to FIG. 1. Connecting openings 11 can be obtained in a known manner by inserting corresponding parts.

Figure 4:
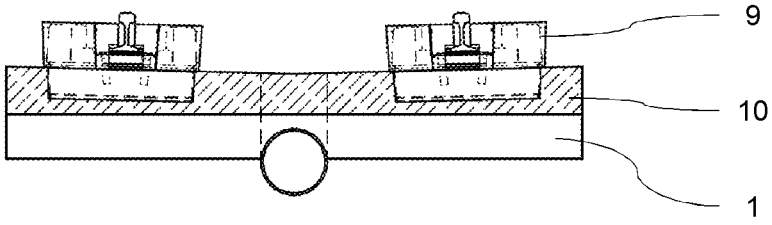

FIG. 4 only differs from FIG. 3 in that the supporting and aligning device 4 has been removed in the stage according to FIG. 4. Starting from the situation depicted in FIG. 4, an emergency pathway 12 can now be cast as illustrated in FIG. 5. Non-reinforced concrete may be used for emergency pathway 12 also.

Figure 6:
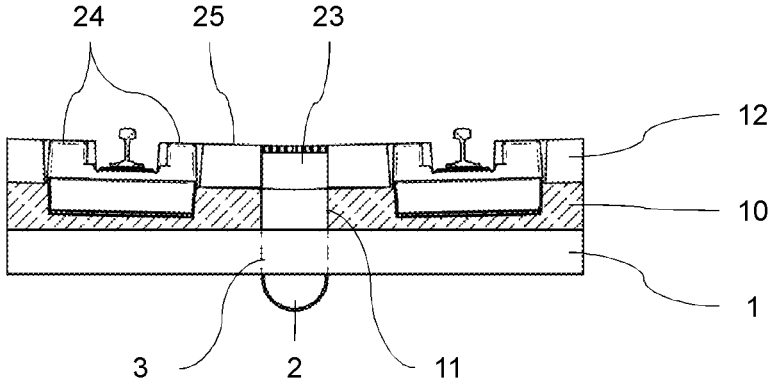

FIG. 6 shows the condition of the track after the removal of the formwork hoods. Transversely to the track, emergency pathway 10 is divided into blocks, and a joint is arranged between two respective emergency pathway blocks, as will become clearer below in the description of FIG. 9. Drainage shafts 23 are arranged between two respective emergency pathway blocks and aligned with underlying connecting openings 11.

Furthermore it is clearly visible in FIG. 6 that shoulders 24 of sleeper blocks 5 are flush with surface 25 of emergency pathway 12. In this manner, gaps as they would remain in emergency pathway 12 in the case of conventional sleeper blocks without heightened shoulders after removing the formwork hoods are closed by shoulders 24 to such an extent that a risk of accidents is largely eliminated.

Figure 7:
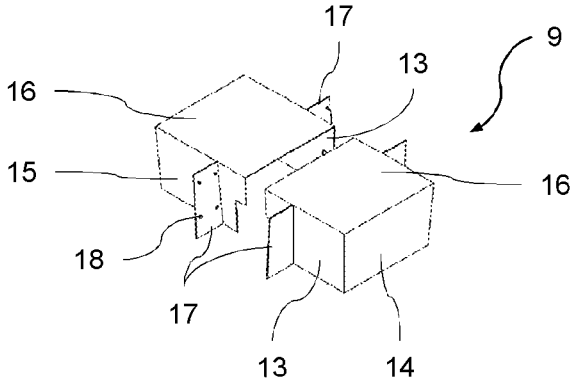
FIG. 7 is a perspective view of a pair of formwork hoods.
Figure 8:
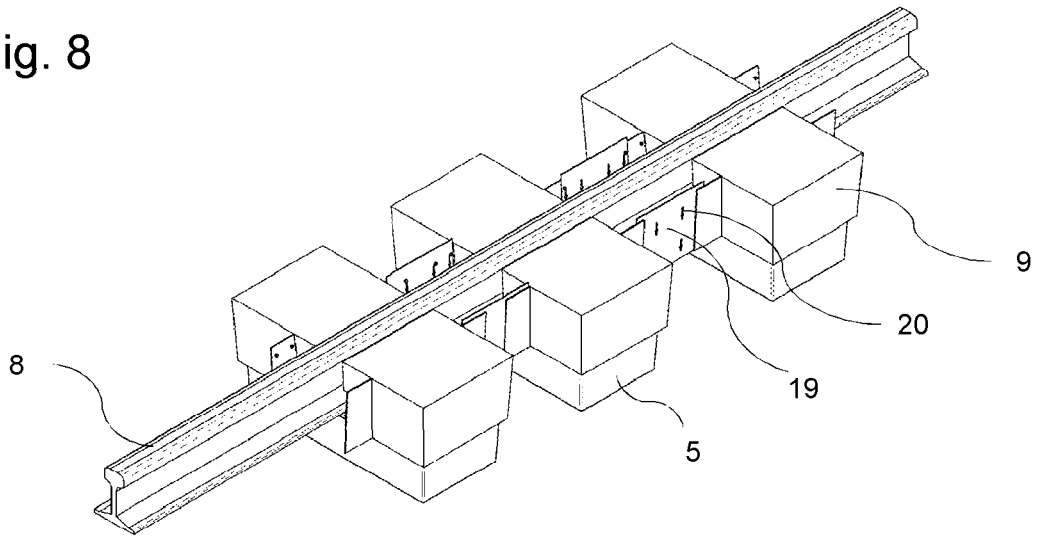
FIG. 8 is a perspective view of a rail section with fitted and interconnected formwork hoods.

FIG. 7 shows a pair of formwork hoods 9 in a perspective view. Each formwork hood 9 has two side walls 13, 15, a rear wall 14, and a top wall 16 and is open on the side that is to face rail 8. On both side walls 13, 15, connecting parts 17 with bolts 18 are arranged that are intended for fastening a connecting plate 19 (FIG. 8). Formwork hoods 9 may consist of sheet metal, synthetic material, wood, or another suitable material. To allow formwork hoods 9 to be removed by lifting them off after the concrete of emergency pathway 12 has hardened, they have a slightly conical shape. This means that side walls 13, 15 and rear wall 14 are inclined about 3 degrees relative to the vertical so that the formwork hood tapers from the top to the bottom.

FIG. 8 shows a section of a rail 8 with three sleeper blocks 5 covered with formwork hoods 9. Also clearly visible in this Figure are connecting plates 19 each connecting two respective formwork hoods 9. To fasten connecting plates 19 to connecting parts 17 of formwork hoods 9, connecting plates 19 are provided with openings 20 in which bolts 18 provided on connecting parts 17 engage. Connecting plates 19 serve the purpose of preventing that the concrete of emergency pathway 12 from reaching rail 8 while it is still flowable. With regard to connecting plates 19, different embodiments of formwork hoods 9 may be contemplated. Thus, instead of connecting parts 17, grooves may be provided in side walls 13, 15 of formwork hoods 9, in which connecting plates 19 can be inserted. Also, two short connecting parts may form an elongated gap between them that has the same function as a groove. Alternatively, connecting plates 19 may be permanently connected to respective formwork hoods 9 and extend to the adjacent formwork hoods 9.

Figure 9:
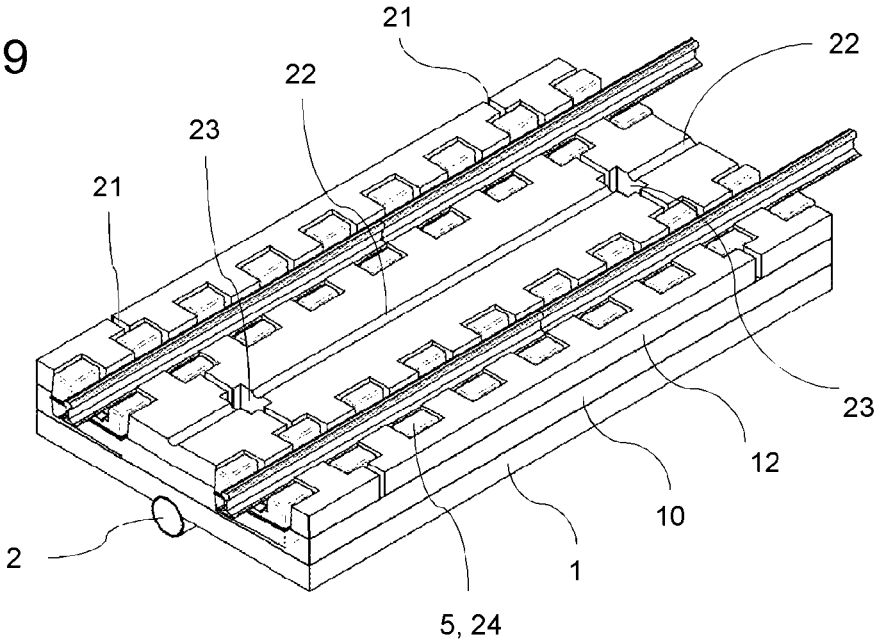
FIG. 9 is a perspective view of a section of a slab track according to the invention.

FIG. 9 shows a perspective view of a track section. From bottom to top, substructure 1, track slab 10, and emergency pathway 12 are visible. It is also clearly visible that a clearance is left between emergency pathway 12 and sleeper blocks 5 and rails 8. Shoulders 24 of sleeper blocks 5 are substantially flush with the surface of emergency pathway 12 so that no major openings remain in the emergency pathway in these locations that might result in a risk of accidents particularly for pedestrians. Between two respective sections of the emergency pathway there is a joint 21, and a drainage channel 22 extends centrally between rails 8 in parallel to the latter. Between two respective sections of emergency pathway 12, a vertical drainage shaft 23 is formed into which drainage channel 22 opens. Drainage shaft 23 is connected to drainpipe 2 by connecting openings 3 and 11 (see e.g. FIG. 6).

LIST OF REFERENCE NUMERALS

1 substructure
2 drainpipe
3 connecting opening
4 supporting and aligning device
5 sleeper block
6 rubber shoe
7 inlay

8 rail
9 formwork hood
10 track slab
11 connecting opening
12 emergency pathway
13 side wall
14 rear wall
15 side wall
16 top wall
17 connecting part
18 bolt
19 connecting plate
20 opening
21 joint
22 drainage channel
23 drainage shaft
24 shoulders of 5
25 surface of 12

What is claimed is:

1. Method for producing a slab track for rail vehicles with an emergency pathway for road vehicles comprising the steps of:

supporting and positioning a prefabricated track section with rails and sleepers on a substructure by a supporting and aligning device comprising at least one horizontal member and at least one vertical member;

mounting formwork elements over parts of the sleepers;

producing a track slab by casting in the sleepers;

applying an emergency pathway to the track slab by casting; and afterward removing the formwork elements from the parts of the sleepers, wherein:

the parts of the sleepers project from the track slab, the parts of the sleepers and the rails are separated from the emergency pathway by the formwork elements while the formwork elements are mounted over the parts of the sleepers, and a clearance is left between the emergency pathway and the sleepers and a clearance is left between the emergency pathway and the rails after the step of removing the formwork elements from the parts of the sleepers.

2. Method according to claim 1, wherein the formwork elements are attached before the track slab is cast.

3. Method according to claim 1, wherein the supporting and aligning device is removed before the emergency pathway is cast.

4. Slab track produced according to the method according to claim 1.

5. Slab track according to claim 4, wherein a drainpipe is arranged in the substructure and communicates with the surface of the substructure via connecting openings provided in the substructure at certain intervals.

6. Slab track according to claim 4, wherein the track slab is provided with connecting openings which communicate with the connecting openings provided in the substructure.

7. Slab track according to claim 4, wherein the emergency pathway is divided by joints extending substantially transversely to the rails.

8. Slab track according to claim 6, wherein the emergency pathway is provided with drainage shafts which communicate with the connecting openings of the track slab.

9. Slab track according to claim 4, wherein the surface of the emergency pathway is provided with drainage channels.

10. Slab track according to claim 4, wherein on at least one side of the rail the sleepers have a heightened shoulder whose surface is at least approximately flush with the surface of the emergency pathway.

11. Formwork elements for implementing the method according to claim 1, wherein said formwork elements comprise hoods that are intended to be fitted over parts of the sleepers and of plates connecting adjacent hoods.

12. Formwork elements according to claim 11, wherein the plates are removably connectable to the hoods.

13. Formwork elements according to claim 12, wherein the plates are connectable to the hoods in such a manner that the spacing between adjacent hoods is variable.

* * * * *